US006092570A

United States Patent [19]

Densel et al.

[11] Patent Number: 6,092,570

[45] Date of Patent: Jul. 25, 2000

[54] DRAIN COUPLING

[75] Inventors: David S. Densel, Whitehouse; Ryan J. Williams, Toledo; Michael P. Wells, Holland, all of Ohio

[73] Assignee: Aeroquip Corporation, Maumee, Ohio

[21] Appl. No.: 09/143,747

[22] Filed: Aug. 31, 1998

[51] Int. Cl.[7] ..... F16K 31/122

[52] U.S. Cl. ..... 141/353; 251/354

[58] Field of Search ..... 123/196 R; 251/354; 141/351, 353; 184/1.5

[56] References Cited

U.S. PATENT DOCUMENTS

| | | | |
|---|---|---|---|
| 2,728,509 | 12/1955 | Peterson | 141/353 |
| 3,186,449 | 6/1965 | Tissot-DuPont | 141/353 |
| 4,479,520 | 10/1984 | Holben | 141/1 |
| 4,727,914 | 3/1988 | Anderson, III et al. | 141/105 |
| 4,745,894 | 5/1988 | Laipply et al. . | |
| 4,940,209 | 7/1990 | Fish . | |
| 4,951,723 | 8/1990 | Hoeptner, III . | |
| 4,976,233 | 12/1990 | Bedi et al. . | |
| 5,048,578 | 9/1991 | Dorf et al. . | |
| 5,107,808 | 4/1992 | Mahn et al. . | |
| 5,127,276 | 7/1992 | Prentiss . | |
| 5,327,862 | 7/1994 | Bedi . | |
| 5,373,914 | 12/1994 | Maher . | |
| 5,411,115 | 5/1995 | Bedi et al. . | |
| 5,433,410 | 7/1995 | Foltz . | |
| 5,443,138 | 8/1995 | Bedi et al. . | |
| 5,452,695 | 9/1995 | Bedi . | |
| 5,476,154 | 12/1995 | Sage . | |
| 5,478,049 | 12/1995 | Lescoe . | |
| 5,526,782 | 6/1996 | Bedi et al. . | |
| 5,676,842 | 10/1997 | Bedi et al. . | |
| 5,743,358 | 4/1998 | Bedi et al. . | |

FOREIGN PATENT DOCUMENTS

| | | |
|---|---|---|
| 2 348 363 | 11/1977 | France . |
| 2 370 208 | 6/1978 | France . |
| 23 54 293 | 5/1974 | Germany . |
| WO 96/12132 | 4/1996 | WIPO . |
| WO 98/25068 | 6/1998 | WIPO . |

*Primary Examiner*—Willis R. Wolfe
*Assistant Examiner*—Jason Benton
*Attorney, Agent, or Firm*—Emch, Schaffer, Schaub & Porcello Co., L.P.A.

[57] ABSTRACT

An improved drain coupling of the type having a male coupling half including a body having an inner body end and an outer body end. A passage axially extends through the body intersecting the body ends. A valve is axially reciprocally mounted within the passage between a closed position and an open position for regulating flow of fluid through the passage. The improvement includes, among other things, a valve having a first valve end adjacent to the inner body end and a second valve end adjacent to the outer body end. The valve has a central portion positioned at a center of the valve adjacent to the second valve end.

11 Claims, 4 Drawing Sheets

DRAIN COUPLING

BACKGROUND OF THE INVENTION

The present invention relates generally to a drain coupling. More specifically, the invention is directed to a drain coupling having, among other things, an improved valve.

The present invention is directed to a drain coupling having a male coupling half that replaces an oil pan plug of an internal combustion engine. The male coupling half mates with a female coupling half to allow the oil pan to be quickly and efficiently drained.

An example of a prior art drain coupling is shown in U.S. Pat. No. 4,745,894 (Laipply et al.). In the Laipply et al. patent, the drain coupling includes, among other things, a tubular valve that is axially reciprocally mounted within the passage of the body of the male coupling half in order to regulate flow of fluid through the passage. It has been found that there is a need for an improved valve. The present invention satisfies this need.

SUMMARY OF THE INVENTION

The present invention is directed to an improved drain coupling of the type having a male coupling half including a body having an inner body end and an outer body end. A passage axially extends through the body intersecting the body ends. A valve is axially reciprocally mounted within the passage between a closed position and an open position for regulating flow of fluid through the passage.

The improvement of the present invention includes, among other things, a valve having a first valve end adjacent to the inner body end and a second valve end adjacent to the outer body end. The valve has a central portion being positioned at a center of the valve adjacent to the second valve end.

A primary object of the present invention is to provide a drain coupling having an improved valve for regulating flow of fluid through the coupling half.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
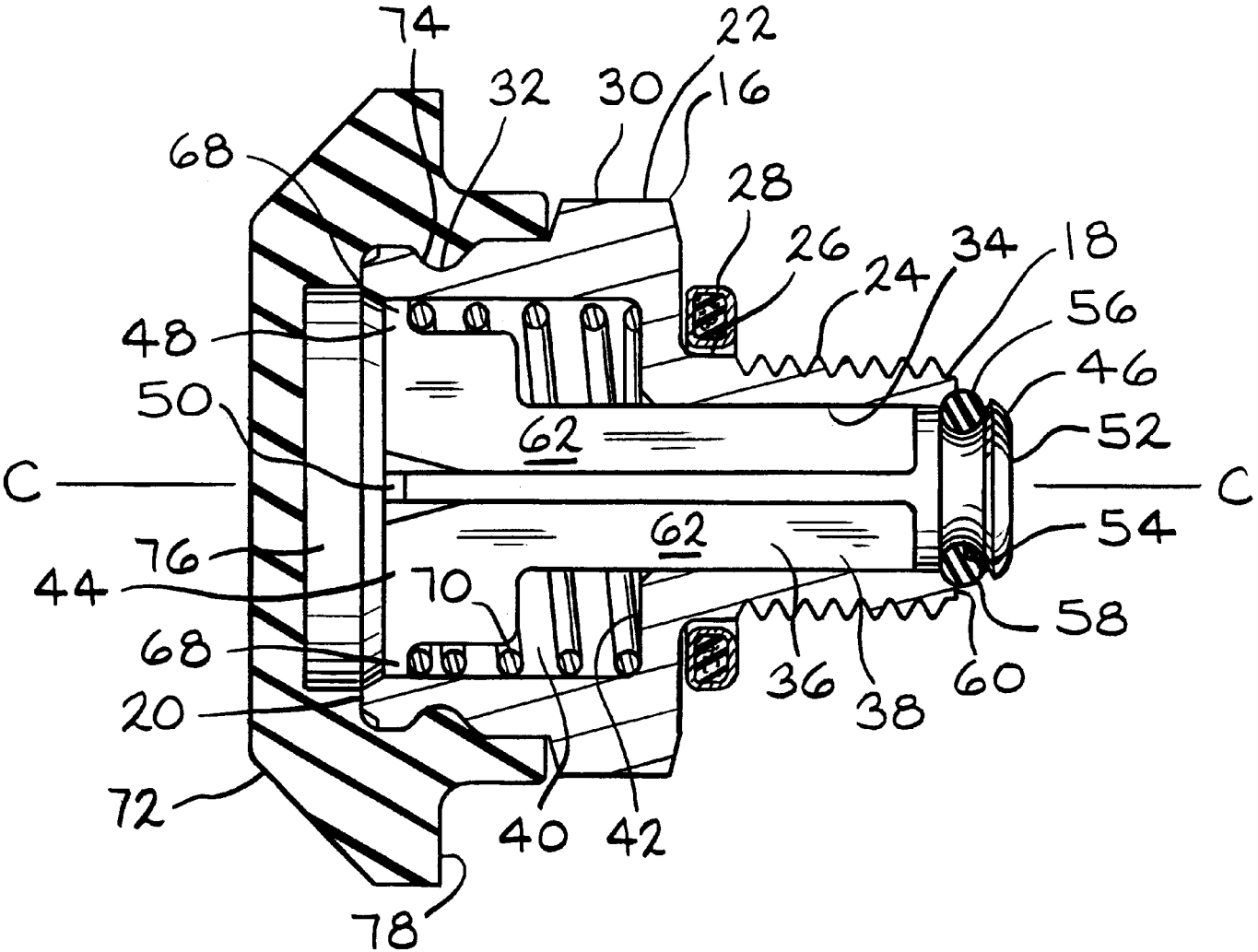
FIG. 1 is a cross-sectional view taken through the center of a male coupling half and a cap according to the present invention.
Figure 2:
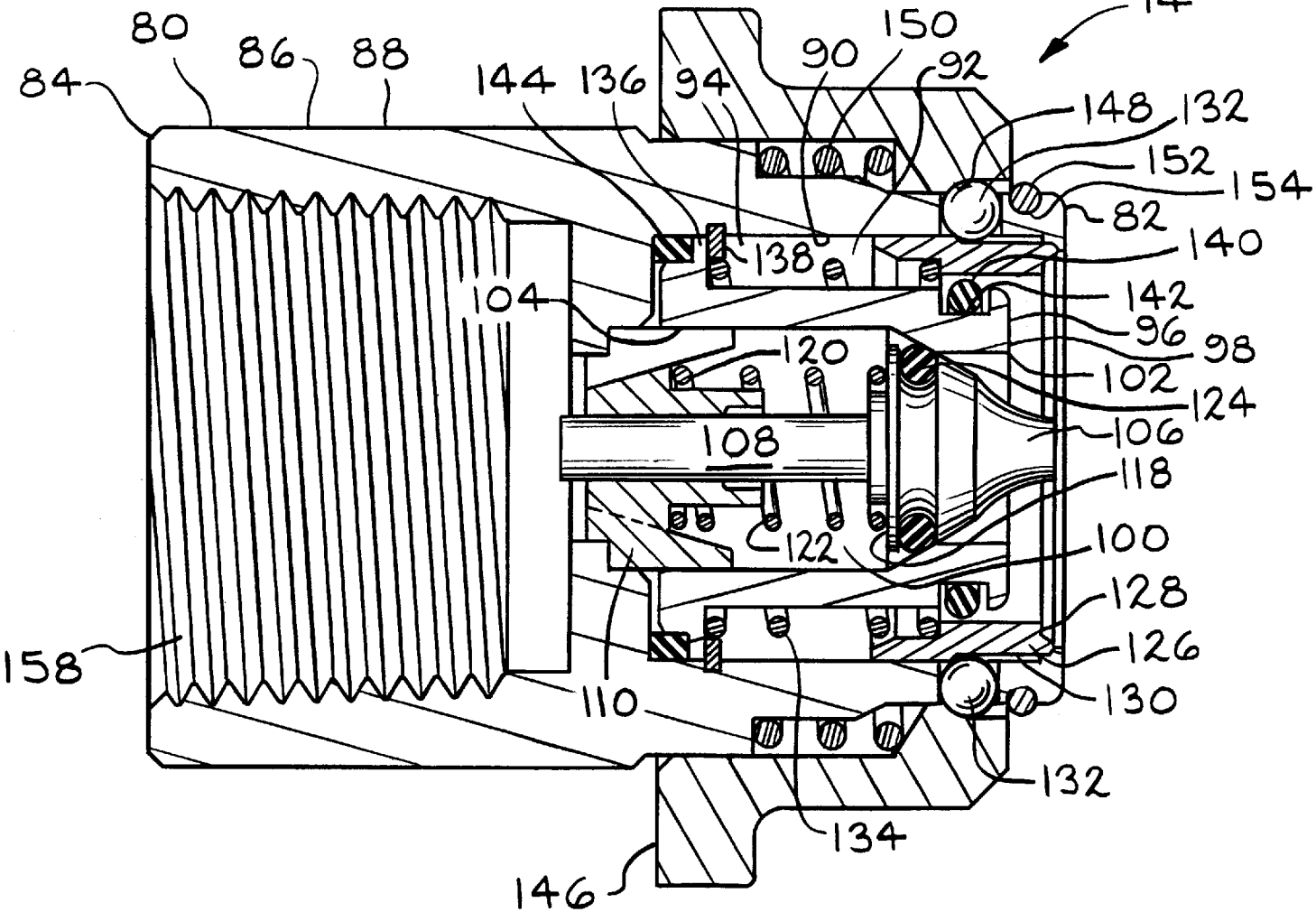
FIG. 2 is a cross-sectional view taken through the center of a female coupling half according to the present invention.

The preferred embodiments and best mode of the present invention will now be described with reference being made to the drawings. The present invention is an improvement of the drain coupling disclosed in U.S. Pat. No. 4,745,894, the teachings of which are incorporated herein by reference. The improved drain coupling of the present invention is indicated generally in the drawings by the reference number "10". The coupling 10 includes a male half coupling 12, as shown in FIG. 1, and a female half coupling 14, as shown in FIG. 2. The male half coupling 12 and the female half coupling 14 are connected to one another to form the drain coupling 10, as shown in FIG. 3.

Referring to FIG. 1, the male half coupling 12 includes a body 16 having an inner body end 18, an outer body end 20 and an exterior surface 22. The exterior surface 22 defines a plurality of threads 24 at the inner body end 18. The threads 24 are adapted to be received by mating threads of an opening of an oil pan (not shown). The exterior surface 22 defines a gasket receiving surface 26 for receiving a gasket 28. The exterior surface 22 defines a plurality of flats 30 adapted to receive, for example, a wrench or other tool (not shown) to apply torque to the body 16. The exterior surface 22 defines an annular groove 32 adjacent to the outer body end 20.

Still referring to FIG. 1, the body 16 includes an interior surface 34. The interior surface 34 defines a passage 36 that axially extends through the body 16 intersecting the body ends 18 and 20. In a preferred embodiment, the passage 36 is generally cylindrical. A first portion of the passage 38 has a diameter that is smaller than a second portion 40 of the passage 36. A shoulder 42 is defined by the interior surface 34 in the second portion 40 adjacent to the first portion 38.

Figure 3:
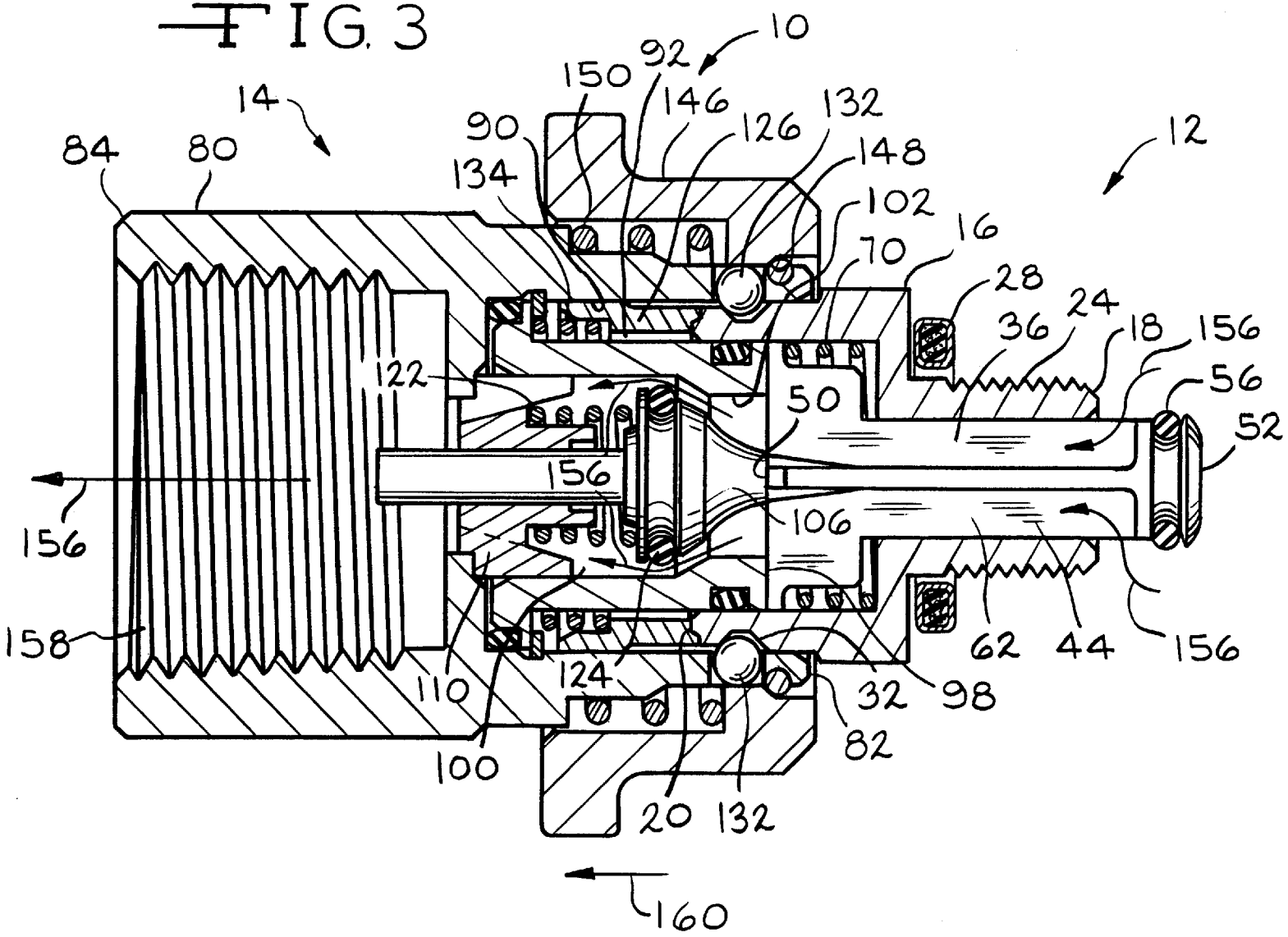
FIG. 3 is a cross-sectional view taken through the center of the improved drain coupling according to the present invention.
Figure 5:
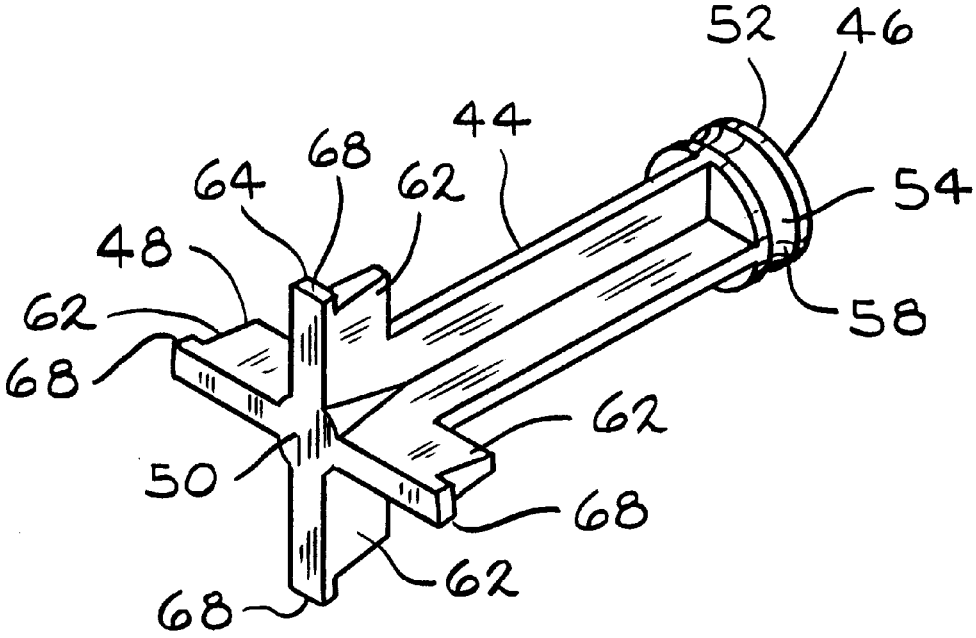
FIG. 5 is a perspective view of an improved valve according to the present invention.

As shown in FIGS. 1, 3 and 5, an improved valve 44 is axially reciprocally mounted within the passage 36 between a closed position, as shown in FIG. 1, and an open position, as shown in FIG. 3. The valve 44 regulates flow of fluid, such as oil, through the passage 36. In a preferred embodiment, the valve 44 is formed of zinc in a conventional zinc die-cast process.

The valve 44 has a first valve end 46 positioned adjacent to the inner body end 18 and a second valve end 48 positioned adjacent to the outer body end 20. As best shown in FIGS. 1 and 5, the valve 44 has a central portion 50 positioned at a center of the valve 44, as represented in FIG. 1 by center line C, adjacent to the second valve end 48.

Referring to FIGS. 1 and 5, the first valve end 46 includes a riveted head 52 that is formed by a conventional riveting process once the valve 44 has been inserted through the passage 36 of the body 16. The first valve end 46 defines a full radius groove 54 adjacent to the head 52 that is adapted to receive an O-ring seal 56. The full radius groove 54 allows the coupling 10 to meet the required operating pressures, temperatures and vibration for use with an internal combustion engine. An example of an O-ring seal 56 that can be used in the present invention is a spring-loaded 90 durometer O-ring seal. However, it should be understood that other types of seals can be used depending on the application. The O-ring seal 56 seals the area between the head 52 and the inner body end 18 of the body 16 when the valve 44 is in the closed position.

As shown in FIGS. 1 and 5, the head 52 defines an engagement surface 58 adjacent to the full radius groove 54 and the inner body end 18 defines a receiving surface 60 adjacent to the passage 36. The engagement surface 58 is adapted to cooperate with the receiving surface 60 to prevent the head 52 from entering the passage 36 in case of failure of the O-ring seal 56. This engagement acts as a redundant seal to prevent leakage of fluid through the passage 36.

As shown in FIGS. 1 and 5, the valve 44 includes at least one fin 62 extending outwardly from the central portion 50. In a preferred embodiment, there are four equally spaced fins 62 arranged in a generally cross-shaped configuration 64 as shown in FIG. 5. The fins 62 extend axially between the first and second valve ends 46 and 48. The fins 62 include fin projections 68 adjacent to the second valve end 48. As shown in FIG. 1, the fins 62 engage the interior surface 34 of the body 16 in the first portion 38. The fin projections 68 engage the interior surface 34 in the second portion 40.

Referring to FIG. 1, the male half coupling 12 includes a compression spring 70 positioned in the second portion 40 between the shoulder 42 and the fin projections 68. The spring 70 applies forces to the fin projection 68 and thus to the valve 44 to bias the valve in the normally closed position as shown in FIG. 1. As described below, the spring 70 can be compressed to allow the valve 44 to move to the open position as shown in FIG. 3 to allow flow of fluid through the passage 36.

As shown in FIG. 1, the male half coupling 12 includes an elastomeric cap 72 having an integral annular bead 74 that is adapted to be received by the annular groove 32 defined by the exterior surface 22 of the body 16. When the cap 72 is positioned on the body 16, as shown in FIG. 1, the cap acts as a redundant seal to prevent leakage of fluid from the passage 36. The cap 72 defines a recess 76 for receiving the second end 48 of the valve 44 in case of failure of the O-ring seal 56. It has been found that the cap 72 of the present invention is an improvement over the prior art metal caps. For example, the cap 72 resists denting and other deformation that might cause failure of the cap. The cap 72 includes an annular lip 78 that can be engaged for easy removal of the cap 72.

The coupling 10 of the present invention further includes a female half coupling 14 as shown in FIG. 2. The female half coupling includes a body member 80 having a leading end 82 and a trailing end 84. The body member 80 defines a body member exterior surface 86 having a plurality of body member flats 88.

Figure 4:
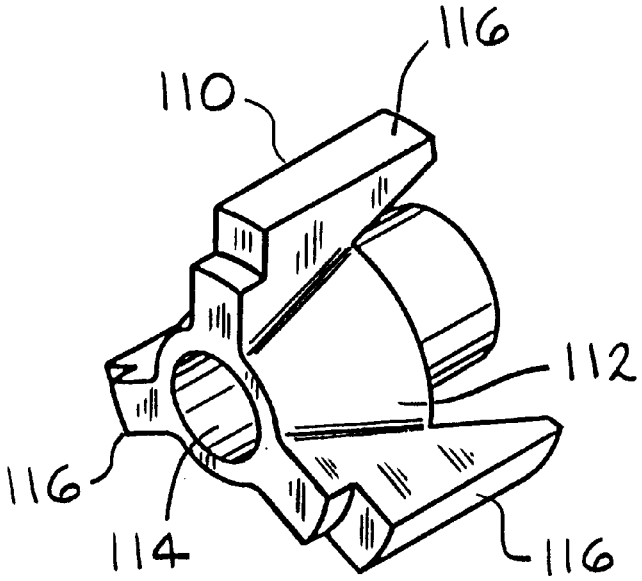
FIG. 4 is a perspective view of a poppet guide according to the present invention.

Still referring to FIG. 2, the body member 80 further includes a body member interior surface 90. The interior surface 90 defines a second passage 92 that extends axially through the female coupling half 14 between the leading and trailing ends 82 and 84. The interior surface 90 defines a valve assembly portion 94 that is adapted to receive a poppet valve assembly 96. The assembly 96 includes a valve body 98 that defines a generally cylindrical valve chamber 100 having an open poppet end 102 and an open poppet guide end 104. A poppet valve 106 having a stem 108 is positioned in the valve chamber 100 adjacent to the poppet end 102. A poppet guide 110, which is shown in detail in FIG. 4, is positioned in the valve chamber 100 and the second passage 92 adjacent to the poppet guide end 104. As shown in FIG. 4, the poppet guide 110 includes a guide body 112 that defines an opening 114 for receiving the stem 108 of the poppet valve 106. Three guide projections 116 extend outwardly from the body 112. Fluid can flow between the projections 116 around the body 112 to allow fluid flow through the second passage 92.

As shown in FIGS. 2 and 4, the poppet valve 106 includes a poppet spring surface 118 and the guide body 112 includes a guide spring surface 120. A compression spring 122 is positioned between the spring surfaces 118 and 120.

Referring to FIGS. 2 and 3, the poppet valve 106 is axially reciprocally mounted in the second passage 92. The poppet valve 106 is maintained in a normally closed position by the compression spring 122 as shown in FIG. 2. However, the spring 122 can be compressed to allow the poppet valve 106 to move to an open position as shown in FIG. 3. As described below, this allows fluid flow through the valve chamber 100 and thus the second passage 92 of the female coupling half 14. An O-ring seal 124 is positioned adjacent to the poppet valve 106 to provide a seal between the valve and the valve body 98.

Referring to FIG. 2, the female half coupling 14 includes a locking sleeve 126 adapted to be received by the interior surface 90 of the body member 80 adjacent to the leading end 82. The locking sleeve 126 includes an engagement end 128 and a ball surface 130. The engagement end 128 is adapted to engage the outer body end 20 of the male half coupling 12. The ball surface 130 is adapted to engage a plurality of balls 132 that is positioned around the locking sleeve 126 by the body member 80. The balls 132 are adapted to be received by the annular groove 32 of the male half coupling 12 to connect the male half coupling 12 to the female half coupling 14. The locking sleeve 126 is maintained by a compression spring 134 that is positioned between the sleeve and an annular projection 136 of the valve body 98. A retaining ring 138 engages the annular projection 136 to maintain the valve body 98 in the second passage 92. An O-ring seal 140 is positioned in a recess 142 defined by the valve body 98 adjacent to the leading end 82. An O-ring seal 144 is positioned between the annular projection 136 of the valve body 98 and the interior surface 90 of the body member 80. As it will be appreciated, the O-ring seals 140 and 144 prevent leakage of fluid from the second passage 92.

As shown in FIG. 2, the female half coupling 14 includes a release sleeve 146 reciprocally mounted on the exterior surface 86 of the body member 80. The release sleeve 146 includes an annular chamfered edge 148 that is adapted to engage the balls 132. A compression spring 150 is positioned between the release sleeve 146 and the exterior surface 86 to bias the release sleeve with respect to the exterior surface. A retaining ring 152 is positioned in a recess 154 defined by the exterior surface 86 of the body member 80 to prevent the release sleeve 146 from being removed from the body member 80.

Referring to FIG. 3, the connection of the male half coupling 12 to the female half coupling 14 to form the drain coupling 10 is shown. When a fluid, such as oil, from an oil pan of an internal combustion engine is to be drained, the outer body end 20 of the male half coupling 12 is inserted in the leading end 82 of the body member 80 of the female half coupling 14. The outer body end 20 of the male half coupling 12 engages the locking sleeve 126. This causes the locking sleeve 126 to move into the second passage 92. This causes the spring 134 to compress. The outer body end 20 travels into the second passage 92 adjacent to the interior surface 90 of the female half coupling 14 until the balls 132 drop into the annular groove 32. This creates a positive connection between the male half coupling 12 and the female half coupling 14. As shown in FIG. 3, the balls 132 move away from the chamfered edge 148 of the release sleeve 146. The release sleeve 146 maintains the balls 132 in the annular groove 32.

Still referring to FIG. 3, as the outer body end 20 of the male half coupling 12 is inserted in the second passage 92 of the female half coupling 14, the poppet valve 106 engages the central portion 50 of the improved valve 44. This engagement causes the poppet valve 106 and the O-ring seal 124 to move away from the valve body 98 in order to open the poppet end 102 and thus the valve chamber 100. This movement causes compression of the spring 122. The engagement of the poppet valve 106 with the central portion 50 of the valve 44 also causes the valve 44 to move upwardly or in the direction away from the movement of the female half coupling 14. As shown in FIG. 3, this results in the head 52 and the O-ring seal 56 being moved away from the inner body end 18 of the body 16. This opens the valve 44 to allow oil to flow from the oil pan into the passage 36 of the male half coupling 12. The movement of the valve 44 causes the spring 70 to become compressed.

When the coupling 10 is in the open position as shown in FIG. 3, oil can flow in the direction indicated by the arrows 156. The oil is discharged from the trailing end 84 of the female half coupling 14. In this regard, the interior surface 90 of the female half coupling 14 defines a plurality of threads 158 for mating with threads positioned on a hose or other fluid conduit (not shown).

Still referring to FIG. 3, after the oil pan has been drained, the female half coupling 14 can be disconnected from the male half coupling 12 by grasping the release sleeve 146 and pulling it in the direction indicated by the arrow 160. This causes the balls 132 to be released from the annular groove 32 to disconnect the coupling halves. When the coupling halves 12 and 14 are disconnected, the poppet valve 106 and O-ring seal 124 once again engage the valve body 98 of the female half coupling 14 and the valve 44 and O-ring seal 56 once again engage the inner body end 18 of the male half coupling 12. The male half coupling 12 is then in the closed position as shown in FIG. 1 and the female half coupling 14 is in the closed position as shown in FIG. 2. The cap 72, as shown in FIG. 1, can then be placed on the outer body end 20 of the male half coupling 12 as described above.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A drain coupling comprising:

a male coupling half including a body having an inner body end and an outer body end with a first passage axially extending through said body intersecting said body ends;

a first valve axially reciprocally mounted within said first passage between a closed position and an open position for regulating flow of fluid through said first passage, said first valve having an inner valve end adjacent to said inner body end and an outer valve end adjacent to said outer body end, said first valve having a central portion being positioned generally at a center of said first valve adjacent to said outer valve end;

a female coupling half having a leading end and a trailing end with a second passage axially extending between said leading and trailing ends; and a second valve axially reciprocally mounted between a closed position and an open position in said second passage for regulating flow of fluid through said second passage, whereby said second valve engages said central portion of said first valve of said male half coupling to move said first valve from said closed position to said open position and to move said second valve from said closed position to said open position to allow flow of fluid through said first passage of said male coupling and said second passage of said female coupling.

2. The drain coupling of claim 1, wherein said inner valve end defines a full radius groove, an O-ring seal being positioned in said groove.

3. The drain coupling of claim 1, wherein said first passage is generally cylindrical and said inner valve end includes a generally circular head, said head having a diameter greater than the diameter of said first passage at said inner body end.

4. The drain coupling of claim 3, wherein said head defines an engagement surface and said inner body end defines a receiving surface, said surfaces being adapted to engage one another.

5. The drain coupling of claim 1, wherein said first valve includes at least one fin extending outwardly from said central portion, said fin axially extending between said inner and outer valve ends, said fin engaging said body to maintain said first valve in said first passage.

6. The drain coupling of claim 5, wherein said first valve includes four spaced fins arranged in a generally cross-shaped configuration.

7. The drain coupling of claim 1, wherein said coupling further includes a cap having attachment means for attaching said cap to said outer body end.

8. The drain coupling of claims 7, wherein said attachment means consists of an annular bead defined by said cap and an annular groove defined by said body adjacent to said outer body end, said bead being adapted to cooperate with said groove to attach said cap to said body.

9. The drain coupling of claim 1, wherein said coupling further includes connection means for connecting said female half coupling to said body.

10. The drain coupling of claim 9, wherein said connection means consists of at least one ball positioned on said female half coupling adjacent to said leading end and an annular groove defined by said body adjacent to said outer body end, said ball being adapted to cooperate with said groove to attach said female half coupling to said body.

11. The drain coupling of claim 10, wherein said connection means further consists of a release sleeve reciprocally mounted on said female half coupling, said release sleeve being adapted to remove said ball from said groove to disconnect said female coupling half from said body.

* * * * *